US006621024B1

(12) United States Patent
Bello

(10) Patent No.: US 6,621,024 B1
(45) Date of Patent: Sep. 16, 2003

(54) SEALED SWITCH ASSEMBLY

(76) Inventor: David P. Bello, 3100 NW. Boca Raton Blvd., Suite 203, Boca Raton, FL (US) 33431

( * ) Notice: Subject to any disclaimer, the term of this patent is extended or adjusted under 35 U.S.C. 154(b) by 0 days.

(21) Appl. No.: 10/117,583

(22) Filed: Apr. 4, 2002

(51) Int. Cl.[7] ..... H01H 13/06
(52) U.S. Cl. ..... 200/302.2; 200/5 R; 200/281
(58) Field of Search ..... 200/302.1, 302.2, 200/17 R, 5 R, 18, 293, 296, 5 A, 520, 341, 86.5, 281

(56) References Cited

U.S. PATENT DOCUMENTS

| | | | | | |
|---|---|---|---|---|---|
| 4,267,414 | A | * | 5/1981 | Brueggeman | 200/86.5 |
| 4,344,224 | A | | 8/1982 | Ditzig | |
| 4,511,600 | A | * | 4/1985 | Leas | 136/256 |
| 4,794,215 | A | * | 12/1988 | Sawada et al. | 200/83 J |
| 4,877,930 | A | | 10/1989 | Fukuma | |
| 5,283,407 | A | * | 2/1994 | Pohl | 200/302.3 |
| 5,340,953 | A | * | 8/1994 | Krebs et al. | 200/5 R |
| 5,453,589 | A | | 9/1995 | Mayer | |
| 5,667,060 | A | | 9/1997 | Luzzi | |
| 5,804,886 | A | | 9/1998 | Danielson et al. | |
| 5,887,704 | A | * | 3/1999 | Schorpp et al. | 200/296 |
| 5,952,634 | A | * | 9/1999 | Yoshida | 200/302.2 |
| 5,957,272 | A | * | 9/1999 | Kim | 200/302.2 |
| 6,238,771 | B1 | * | 5/2001 | Nakao | 200/302.2 |
| 6,271,491 | B1 | * | 8/2001 | Ono et al. | 200/16 D |
| 6,437,267 | B1 | * | 8/2002 | Imai | 200/302.1 |

FOREIGN PATENT DOCUMENTS

| | | |
|---|---|---|
| DE | 2140623 | * 11/1984 |
| JP | 4-329228 | * 11/1992 |

* cited by examiner

*Primary Examiner*—Lincoln Donovan
*Assistant Examiner*—Lisa N Klaus
(74) *Attorney, Agent, or Firm*—John C. Smith

(57) ABSTRACT

A switch housing assembly which uses an internal pressure bracket to simultaneously provide pressure against multiple switches located in multiple locations within the switch housing assembly. The pressure bracket creates a fluid seal between the flexible switch buttons and the switch housing by pressing the switches against the switch buttons which in turn are pressed directly against the inner surface of the switch body. Multiple switches are simultaneously secured to the switch housing by an internal bracket which simultaneously provides pressure against the backs of multiple switches. An optional pressure ring focuses pressure from the periphery of the switch assembly to the outer peripheral ring of the flexible switch button. The bracket assembly is preferably secured to the switch housing by a single removable screw to allow disassembly when needed. Optionally, the securing screw has a female threaded aperture to allow a second screw to secure the switch housing to the body of the laparoscopic surgical instrument.

18 Claims, 9 Drawing Sheets

SEALED SWITCH ASSEMBLY

BACKGROUND OF THE INVENTION

1. Technical Field

The present invention relates to switch assemblies. In particular, it relates to a sealed switch assembly for use in environments exposed to fluids and a method of repairing the switches such that the seals remain intact after replacement.

2. Background Art

Recent advances in the medical arts, particularly in the field of surgery, have resulted in the development of a variety of sophisticated high technology instruments. Many of these devices include a variety of manual switch assemblies designed to allow a surgeon to activate particular functions while operating on a patient. One group of such instruments includes laparoscopic, colonoscopic, gastroscopic, and other surgical devices designed to be manipulated by a surgeon working through small apertures in the body wall of the patient, or in body cavity openings, during surgery. For ease of discussion, any of these or other devices shall be referred to by the single term: "laparoscopic" device, with the understanding that, as used herein, the term laparoscopic device is intended to cover any device capable of using the subject matter of this invention. It is common when using laparoscopic surgical devices to have multiple switches arranged upon the handle of the device which allows a surgeon to perform multiple functions with a single hand.

Due to the nature of their use, laparoscopic surgical instruments require meticulous cleaning between uses. If the housing assembly which holds the switches is not properly sealed, the cleaning process itself may often create problems. For example, there may be damage to switches caused by cleaning fluids and/or contamination of the switch housing by the cleaning fluids. This can be caused by leakage of cleaning solutions into the switch housing which secures the switches.

The switch housing is normally designed to provide a tight external fluid seal which prevents entrance of fluids into the inside the switch housing, while simultaneously providing a flexible manually operable switch button which permits the surgeon to activate the switches on the switch housing. One method of providing the fluid seal has been to secure the switches to apertures on the switch housing such that they can be activated from the outside of the housing by the surgeon, and to seal the switch housing assembly by covering the aperture and the switch with a flexible switch button which is adhered to the outer surface of the switch housing. This causes a common problem related to laparoscopic surgical instruments, as well as other instruments which use switches that are sealed by flexible switch buttons. The prior art methods of glueing the switch buttons to the exterior of the switch housing assembly requires an excessive amount of work in order to replace the flexible switch button when the switch button is damaged. In order to prepare the surface of the switch housing assembly such that a replacement switch button can be properly secured to it, a substantial amount of time must be spent to ensure that any pre-existing adhesive is removed prior to application of a new cover with fresh adhesive. Failure to do so may result in unwanted leakage points which would allow unwanted fluid flows created during surgery, or cleaning fluids used after the surgery, to enter the device. It would be desirable to have a method of rapidly sealing a switch button to a switch housing assembly, without adhesive, such that no fluid leaks exist between the switch button and the switch housing assembly.

Another attempt to ensure that the seal is maintained in proper working order has been to secure the switch and the switch button from the inside of the housing assembly. This is typically done by securing the switch and the switch button from the inside of the housing and then filling the housing with a material, such as resin, to prevent both the switch and the switch button from moving. This process creates an additional drawback in that the resin, once set, is usually not removable. Therefore, when the seal is broken, the entire switch housing must be discarded and replaced. Due to the fact that these switch assemblies are precision devices, the cost of total replacement of the switch assembly is higher then desired.

Another disadvantage related to current switch housing assemblies used on laparoscopic surgical instruments is the method by which the switches are secured to the switch housing assembly. Prior art devices typically secure the switch to the switch housing assembly and then ensure that it does not move by filling the interior of the switch housing assembly with material such as.resin, epoxy, etc. The disadvantage to this method of securing the switches is that it is extremely difficult to remove the resin if the switch assembly needs repair. As a result, if any of the switches or switch buttons become defective, a common repair procedure is to discard the entire switch housing assembly, along with all of the switches and switch buttons, and to replace them entirely. It would be desirable to be able to minimize costs by replacing, in a rapid and convenient manner, only those components which are actually defective.

While addressing the basic desirability of using flexible switch buttons to provide access to switches inside a switch housing while maintaining a fluid seal, the prior art has failed to provide a switch housing assembly which is inexpensive to manufacture, has a minimum number of components, and can be repaired without with a minimum amount of time and with minimum replacement parts costs.

SUMMARY OF THE INVENTION

The present invention solves the foregoing problems by providing a switch housing assembly which uses an internal pressure bracket to simultaneously secure multiple switches to multiple locations within the switch housing assembly. One or more switches each secure a flexible fluid sealing switch button to the inside of the switch housing by applying pressure directly from the switch body against the switch button. In turn, the switches are simultaneously secured to the switch buttons by the internal bracket which simultaneously provides pressure against the backs of one or more switches. The bracket assembly is preferably secured to the switch housing by a single removable screw which allows disassembly when needed. Optionally, the securing screw has a female threaded aperture to allow a second screw to secure the switch housing to the body of the laparoscopic surgical instrument.

DESCRIPTION OF THE PREFERRED EMBODIMENT

Figure 1A:
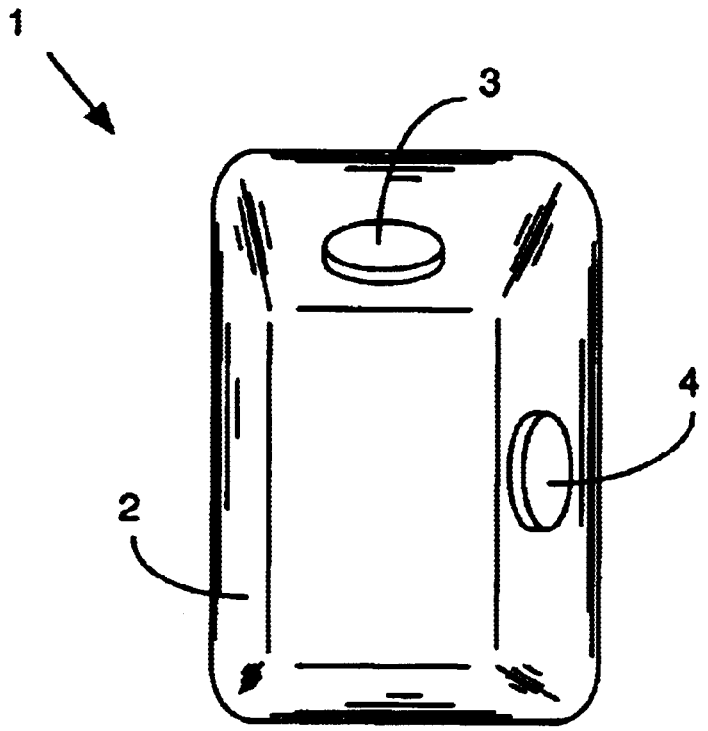
FIG. 1A is a top view of a preferred embodiment of a switch housing assembly with a first switch button shown extending from a distal end surface of the switch housing assembly, and a second switch button shown extending from a side surface of the switch housing assembly.

Prior to a detailed discussion of the figures, a general overview of the features and advantages of the invention will be provided. Medical devices, such as laparoscopic surgical instruments, require a high degree of precision both in their manufacture and in their maintenance. The high quality required for these devices also results in high cost to both produce and/or maintain them. Likewise, those skilled in the art will realize that switches which require fluid seals are not limited to the medical arts, and can be used in a wide variety of applications. The purpose of this invention is to provide a new structure and method of repair for the switch assemblies.

The invention eliminates the need to use adhesive to secure the switch button to the switch housing. As a result, the time required to replace the switch buttons is. drastically reduced because the replacement process does not require careful removal of any residual adhesive and/or switch button material from the switch housing. The invention provides a flexible switch button which is removably secured to the switch housing by high-pressure exerted against it by the switch itself. The periphery of the switch button extends laterally from the switch button to form a fluid seal when pressed against the switch housing by the switch. A bracket is secured to the inside of the switch housing and is formed such that it can be pressed against multiple switches to simultaneously apply pressure to secure multiple switches and their respective switch buttons to the switch housing.

Those skilled in the art will recognize that the particular shape of the switch housing will vary depending on the design requirements of a particular laparoscopic instrument or other device. Likewise, the shapes of the switches, switch buttons, brackets, etc. will also vary depending on those same design requirements. In addition, the materials used to construct the components of the switch housing assembly, including the switch housing, the switches, the switch buttons, the bracket, etc., can be fabricated from any suitable material. The only requirements are that the materials selected are suitable for the particular task which the overall device performs, that the switch housing assembly provides an effective fluid seal during operation and/or cleaning, and that the switch housing assembly can be easily disassembled for replacement or repair of discrete components. As a result, the particular shapes and fabrication materials discussed below are provided as illustrative examples only, and do not defme any particular shapes, number or location of switches, or fabrication materials, as a requirement to implement this invention.

The bracket is preferably secured to the inside of the switch housing by one or more screws. By attaching the bracket to the switch housing in this manner, a defective switch button, and/or switch, can be easily replaced by merely unscrewing the bracket, replacing the defective part, and re-securing the switches and switch buttons by reinstalling the bracket. This procedure requires a minimal amount of time to perform and greatly reduces the time needed to repair the defective switch assembly or switch button. In addition, it also reduces parts cost because only the defective parts are replaced.

An alternative embodiment provides for switch assemblies which are held in place by the bracket, as discussed above, with the exception that the switch button is adhered to the outer surface of the switch housing as is done in prior art systems. This alternative embodiment provides for the same easy maintenance in regard to the switches which was discussed above in regard to the previous embodiments. We now turn to a more detailed discussion of the figures.

In FIG. 1A, a top view of a preferred embodiment of a switch housing assembly 1 is shown. In this embodiment, the switch housing 2 has a first switch button 3 shown extending from an aperture in the distal end surface of the switch housing 2. The first switch button 3 preferably extends above the surface of the switch housing 2 to facilitate activation of the underlying switch 6 (discussed below in regard to FIG. 3) when the surgeon or other user is operating the device. Also shown in this figure is a second switch button 4 which is attached to a second switch 6. The second switch button 4 extends from a side surface of the switch housing 2 in the same manner as the other switch housing 2.

As noted above, those skilled in the art will recognize that the particular shape and fabrication material used to form the switch housing 2 can be anything suitable to accomplish the intended use of the device in question, so long as the device is capable of being easily disassembled for repair or replacement of individual components, and the various components can be secured by a removable bracket 14 (discussed below in regard to FIG. 5). Likewise, the number, shape, and/or location of the switches 3, 4 can also vary to suit the particular purposes of the device in question.

Figure 1B:
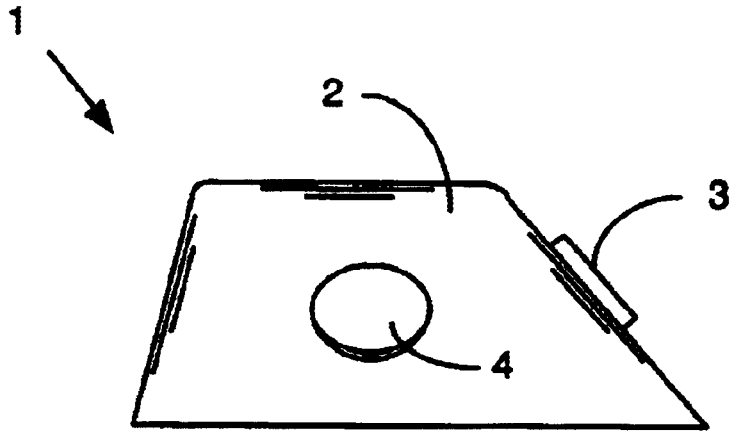
FIG. 1B is a side view of the preferred embodiment of the switch housing assembly of FIG. 1A with the first switch button shown extending from the distal end surface of the switch housing assembly, and a second switch button shown extending from a side surface of the switch housing assembly.

FIG. 1B is a side view of the preferred embodiment of the switch housing assembly 1 of FIG. 1A with the first switch button 3 shown extending from the distal end surface of the switch housing 2, and a second switch button 4 shown extending from a side surface of the switch housing 2.

Figure 2A:
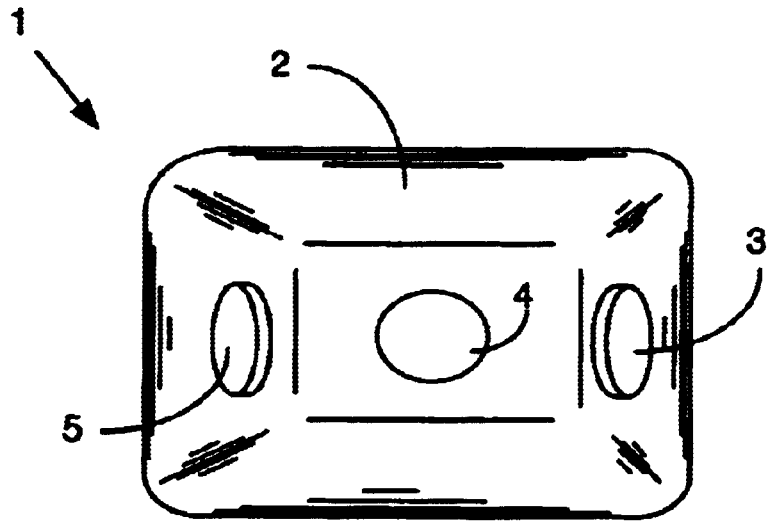
FIG. 2A is a top view of an alternative preferred embodiment of a switch housing assembly with a first switch button shown extending from a distal end surface of the switch housing assembly, a second switch button shown extending from a top surface of the switch housing assembly, and a third switch button shown extending from a proximal end surface of the switch housing.

FIG. 2A is a top view of an alternative preferred embodiment of a switch housing assembly 1 with a first switch button 3 shown extending from the distal end surface of the switch housing 2, a second switch button 4 shown extending from a side surface of the switch housing 2, and a third switch button 5 shown extending from the proximal end surface of the switch housing 2. This alternative embodiment illustrates the fact that the shape and size of the switch housing 2 can vary, and that the switches 6 and the switch buttons 3–5 can be placed in any convenient location.

Figure 2B:
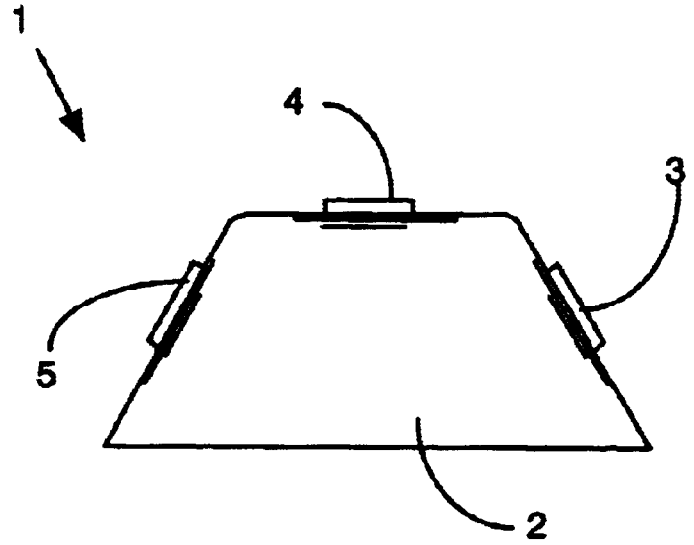
FIG. 2B is a side view of the preferred embodiment of the switch housing assembly of FIG. 2A with a first switch button shown extending from a distal end surface of the switch housing assembly, a second switch button shown extending from a top surface of the switch housing assembly, and a third switch button shown extending from a proximal end surface of the switch housing.

FIG. 2B is a side view of the preferred embodiment of the switch housing assembly of FIG. 2A. In this figure, the first switch button 3 extends from the distal end surface of the switch housing 2, the second switch button 4 is shown extending from the top surface of the switch housing 2, and the third switch button 5 shown extending from the proximal end surface of the switch housing 2. An important function of the switch buttons 3–5 is that they maintain a liquid seal, and that they are positioned in relation to the surface of the switch housing 2 such that the switches 6 are easily activated. Therefore, it is important that the switch buttons 3–5 are firmly secured to be switch housing 2 such that no fluid linkage can occur during use and/or cleaning.

Figure 3:
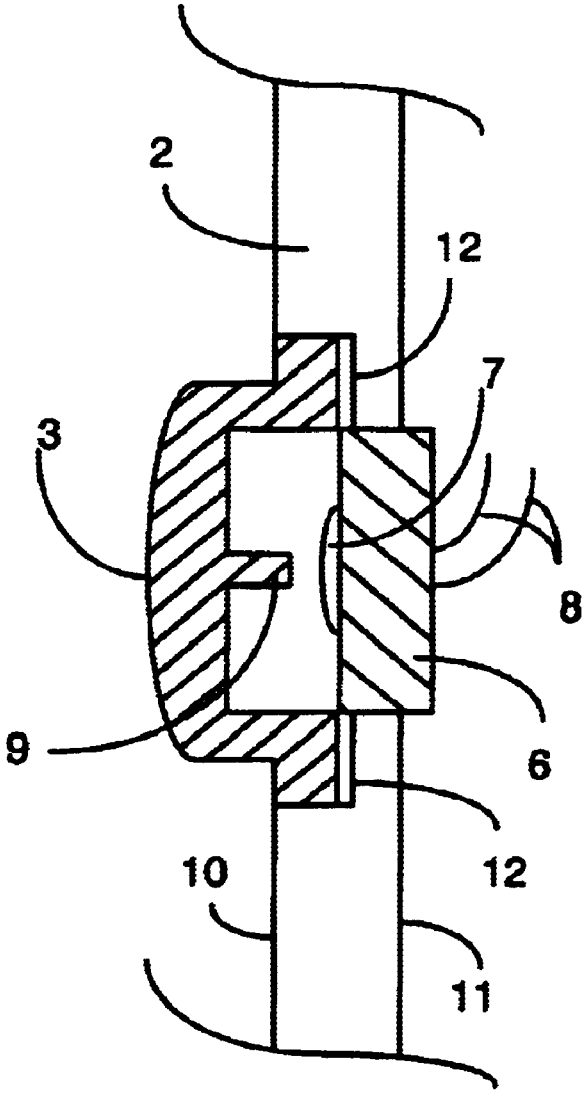
Figure 3 Prior Art
FIG. 3 is a side cutaway view of a prior art switch secured to the wall of the switch housing assembly with a flexible switch button secured to the outer surface of the switch housing assembly via adhesive.

FIG. 3 is a side cutaway view of a prior art switch housing assembly which illustrates how a switch button 3 is secured to the outer surface 10 of the switch housing 2. In this embodiment, the switch button 3 is secured to the switch housing 2 via a layer of adhesive 12 between the outer edge of the switch button 3 and the switch housing 2. The disadvantage associated with this structure is that replacement of the switch button 3 requires that the adhesive 12 be carefully scraped from switch housing 2 prior to installation of a new switch button 3. If the replacement process is not done carefully, residue adhesive may cause leaks which allow contamination of the device during use or during cleaning.

The underlying switch 6 can be secured to an aperture in the wall of the switch housing 2 via pressure fit or adhesive. Likewise, it can also be secured to the inside surface 11 of the switch housing 2 via any suitable means, such as adhesive. During operation, pressure applied to the switch button 3 will cause plunger 9 to press against switch contact 7, thereby activating the switch 6 and completing a circuit between lines 8.

Figure 4:
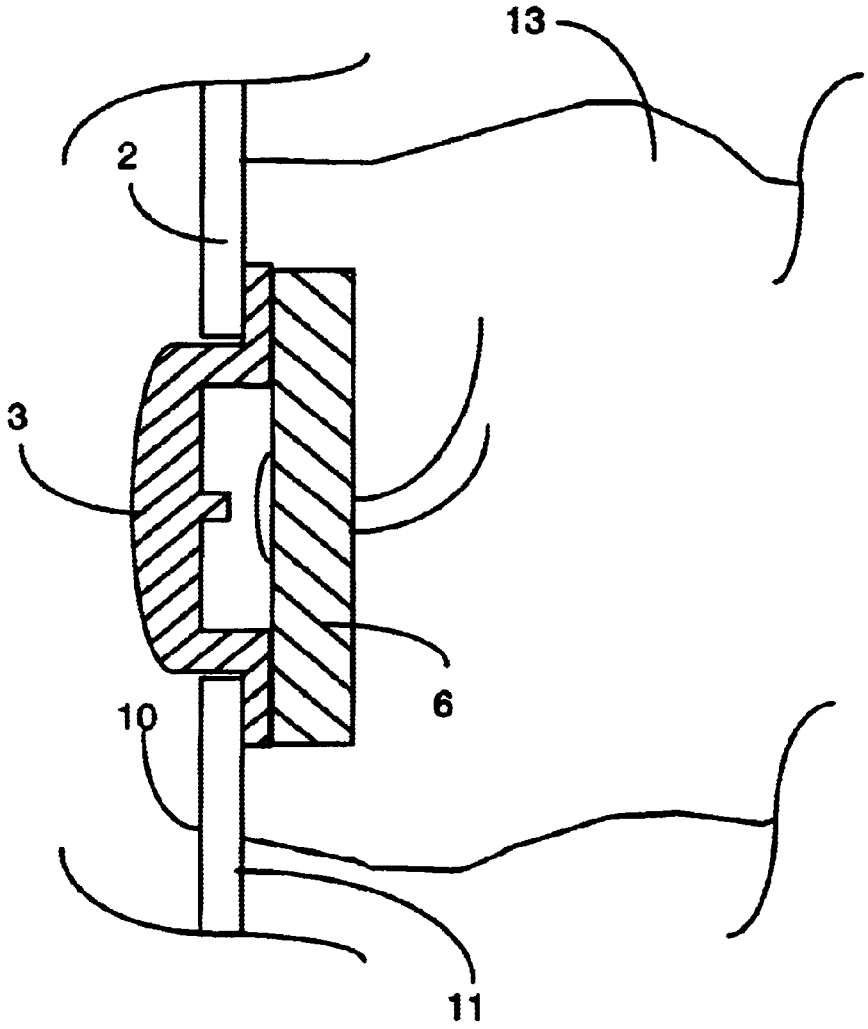
Figure 4 Prior Art
FIG. 4 is a side cutaway view of another prior art switch and flexible switch button secured to the inner wall of a switch housing assembly via resin.

FIG. 4 is a side cutaway view of another prior art switch 6 and flexible switch button 3 secured to the inner wall 11 of switch housing 2. In this embodiment, the flexible switch button 3 and the switch 6 are secured to the switch housing 2 via resin 13 which fills the inside of the switch housing 2. Those skilled in the art will recognize that this creates a substantial disadvantage in that once the resin has hardened, the individual components of the switch housing assembly 1 can no longer be removed for repair. As a result, the failure of a single component leads to the complete replacement of the switch housing assembly 1. This increases the cost of repair substantially above the cost of repair of a switch housing assembly 1 that allows replacement of individual components.

Figure 5:
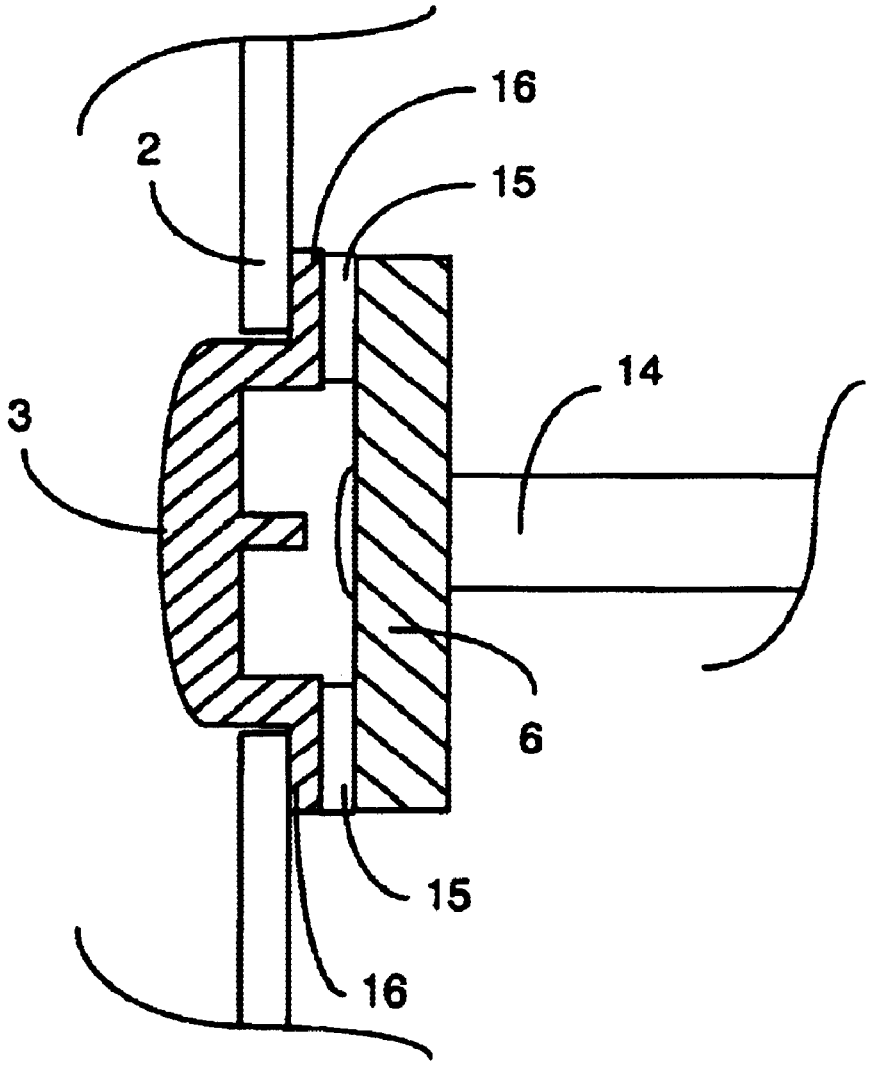
FIG. 5 is a side cutaway view of a preferred embodiment in which a switch with a pressure ring presses the outer peripheral surface of a flexible switch button against the inner surface of the switch housing. A removable pressure bracket presses the switch against the outer peripheral surface of the flexible switch button to provide a seal between the flexible switch button and the inner surface of the switch housing. An optional pressure ring is also shown.

FIG. 5 is a side cutaway view of a preferred embodiment of the invention. In this embodiment, the switch 6 and the switch button 3 are mounted from the inside of the switch housing 2. The central portion of the switch button 3 protrudes through an aperture in the switch housing 2 to allow any user to conveniently activate the switch 6 by pressing the switch button 3. In this embodiment, a removable pressure bracket 14 presses against the back side of switch 6 which in turn presses against switch button 3. The pressure is such that the outer peripheral surface 16 of the switch button 3 is priced fly against the inner wall of the switch housing 2. This pressure provides a fluid seal which prevents contamination of the inside of switch housing assembly 1 during use or cleaning. Also shown in this figure is an optional rigid pressure ring 15 which presses against the outer peripheral surface 16 of the flexible switch button 3. This provides relatively uniform pressure against the entire outer peripheral surface 16 to ensure that there are no leakage points between the switch button 3 and the inner surface of the switch housing 2. Of course, if the switch 6 is carefully constructed, then it can be placed in direct pressure contract with the switch button 3 to achieve the same results. Those skilled in the art will recognize that an alternative embodiment can be constructed in which the optional rigid pressure ring 15 is replaced by adhesive such that the switch button 3 and the switch 6 form a single replaceable unit.

Figure 6:
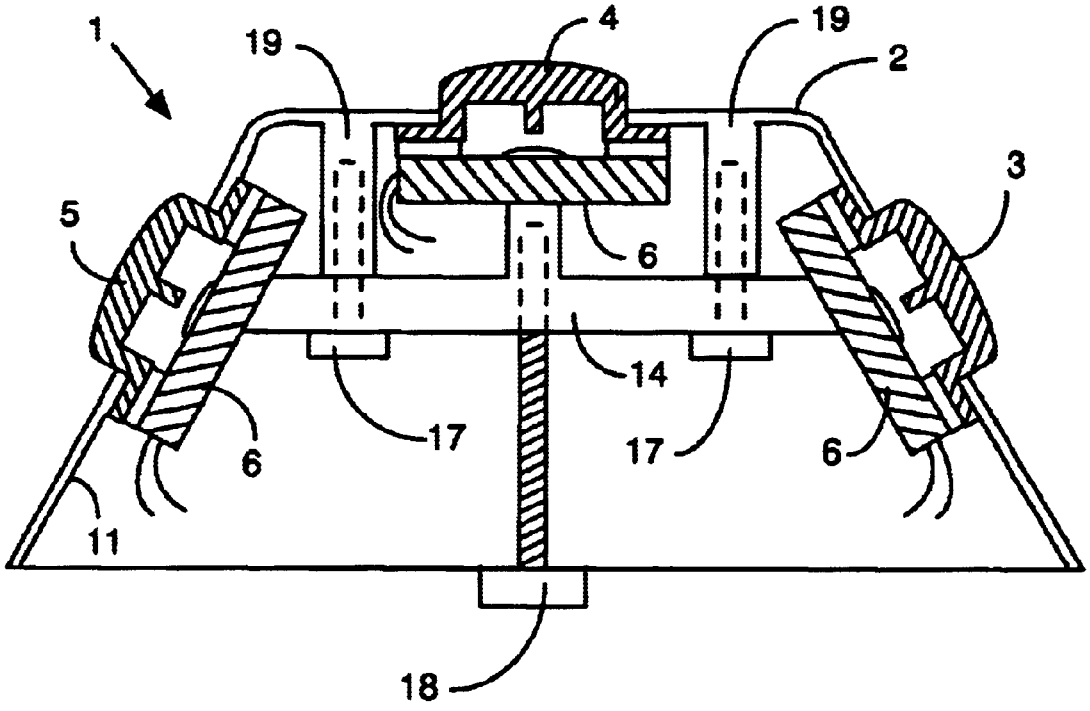
FIG. 6 is a side cutaway view of a preferred embodiment of a switch housing assembly. In this view, switches with associated switch buttons are shown secured to the inner wall of the switch housing assembly that the distal end, the proximal end, and a top surface. A single pressure bracket is shown secured to the switch housing to provide pressure to all three switches. A single mounting screw provides for attachment of the switch housing assembly to a laparoscopic surgical instrument or other device.

FIG. 6 is a side cutaway view of an alternative preferred embodiment of a switch housing assembly 1. In this view, switches 6 with associated switch buttons 3–5 are shown secured to the inner wall 11 of the switch housing 2 at the distal end, the proximal end, and the top surface of switch housing 2. A single pressure bracket 14 is shown secured to the switch housing 2 via bracket screws 17. In a preferred embodiment, the pressure bracket 14 is sized to provide pressure to all three switches 6 simultaneously. In the event that a switch button 3–5 or a switch 6 is defective, the individual component can be easily replaced by simply removing bracket screws 17 which are threaded into posts 19 to release the pressure provided by pressure bracket 14. Once this is done, the remaining components can be easily removed for repair or replacement.

Also shown in this figure is a switch assembly mounting screw 18 which is designed to attach the switch housing assembly 1 to a laparoscopic surgical instrument or other device. Of course, the finction of bracket screws 17 and/or switch assembly mounting screw 18 can be implemented by any suitable method.

Those skilled in the art will recognize that the shape and location of pressure bracket 14 can take any form which is suitable for a particular switch housing assembly 1. Likewise, for purposes of illustration, two bracket screws 17 were illustrated. It is understood that only a single bracket screw 14 may be required to hold the pressure bracket 14 in place. Likewise, more than one bracket screw 14 may be used depending on design considerations. In this figure, switch assembly mounting screw 18 the shown secured directly to pressure bracket 14. However, switch assembly mounting screw 18 can also be designed such that it screws into the end of a bracket screw 17.

As can be seen in this figure, a single pressure bracket 14 can be used to hold any number of switches 6 in place while simultaneously securing multiple switch buttons 3 in pressure contact with switch housing 2 to maintain fluid seals. Likewise, the removal of the single pressure bracket 14 allows all of the other components inside the switch housing assembly 1 to be released for easy access.

Figure 7:
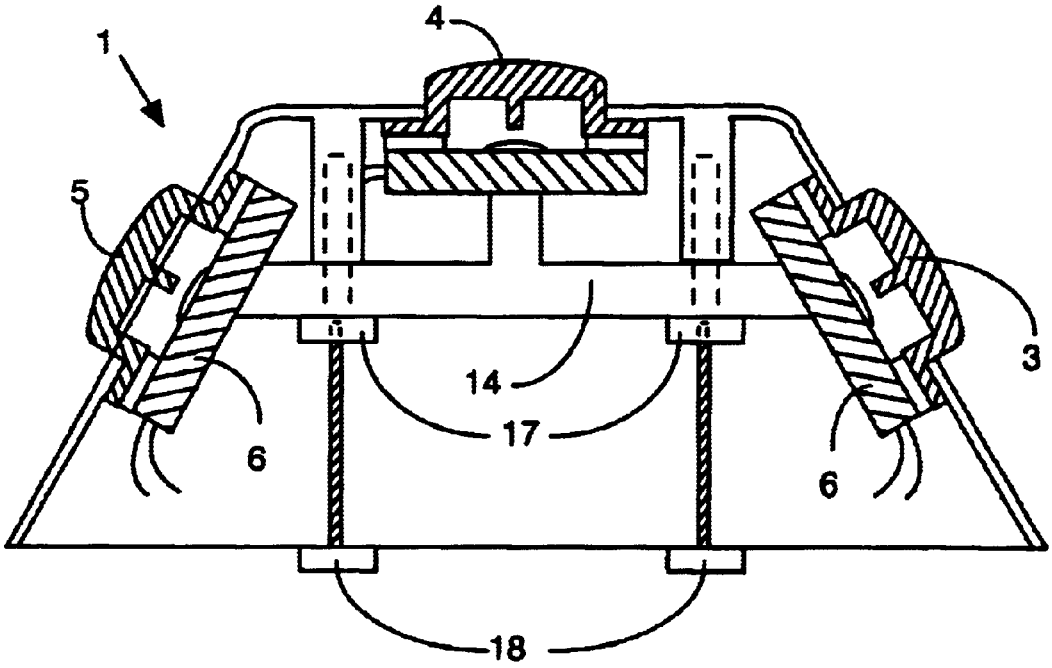
FIG. 7 is a side cutaway view of an alternative preferred embodiment of a switch housing assembly in which multiple screws are used to attach the switch housing assembly to the laparoscopic surgical instrument or other device.

FIG. 7 is a side cutaway view of an alternative preferred embodiment of a switch housing assembly 1 in which multiple switch assembly mounting screws 18 are used to attach the switch housing assembly 1 to the laparoscopic surgical instrument. In this embodiment, it can be seen how the switch assembly mounting screws 18 screw directly into the bracket screws 17. As was mentioned above, this invention can easily be implemented with a single bracket screw 17 and a single switch assembly mounting screw 18. The multiple bracket screws 17 and switch assembly mounting screws 18 which are shown in this figure are used for ease of discussion.

Figure 8:
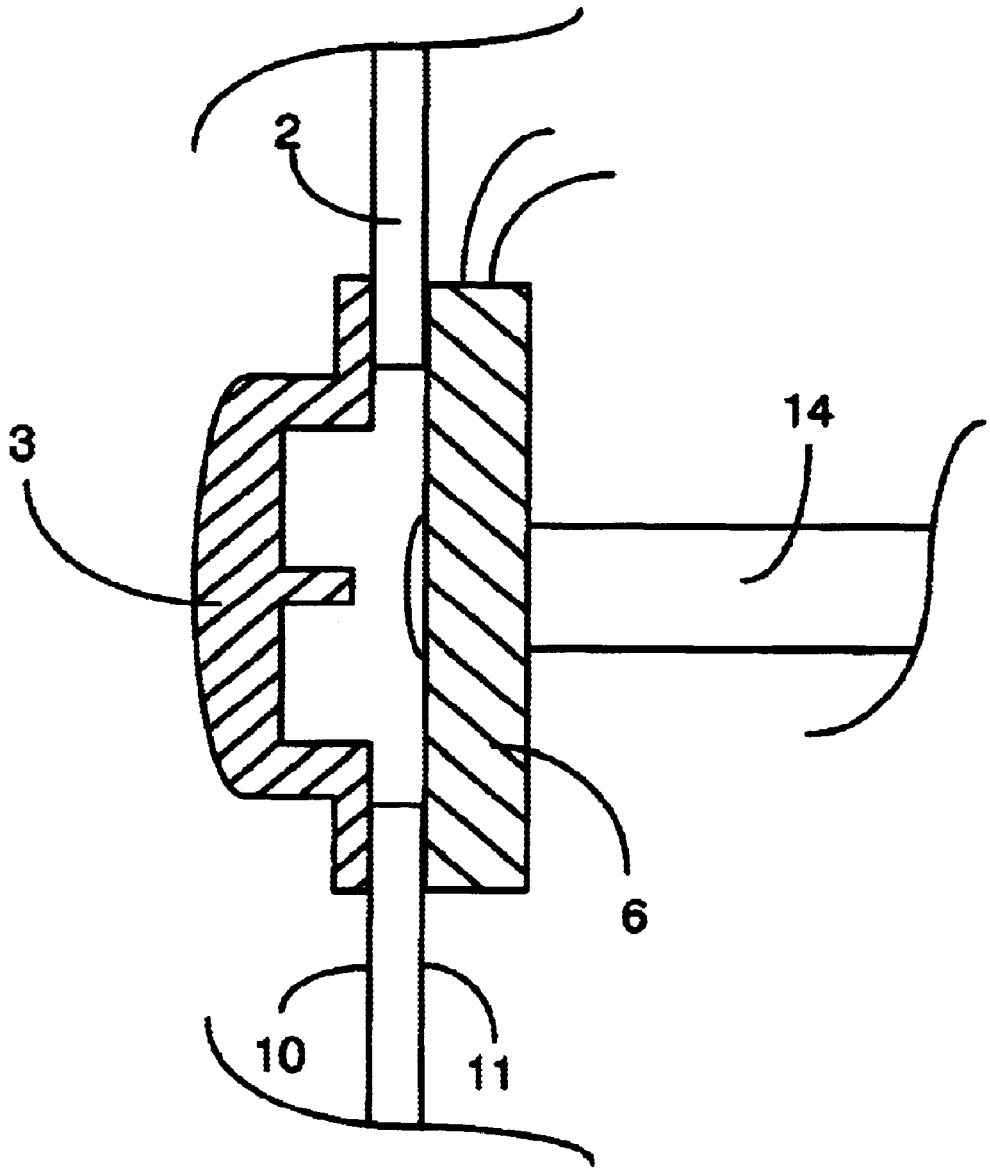
FIG. 8 is a side cutaway view of another alternative preferred embodiment of a switch housing assembly in which the switch is held in pressure contact with the switch housing by a pressure bracket and the switch button is independently secured to the exterior of the switch housing.

In FIG. 8, another alternative embodiment of the invention is presented. In this embodiment, the switch button 3 is independently secured to the outer surface 10 of the switch housing 2. The switch 6 is secured to the interior surface 11 of the switch housing 2 under pressure from the pressure bracket 14 as was discussed in the previous embodiments. This embodiment permits replacement of the switch button 3 without disassembly of the switch bracket assembly 1. However it does have the drawback that it has to be independently secured to the switch housing 2 rather than automatically secured by the switch 6.

As can be seen from the foregoing discussion, the invention presented herein can be implemented in a wide array of design configurations. Any suitable fabrication material may be used so long has the material is suitable for its intended application. Likewise, the number and location of switches 6 used for a particular switch housing assembly 1 can vary to suit the intended use of the switch housing assembly 1. The number of bracket screws 17 used to secure the pressure bracket 14 to the switch housing 2, and the number of switch assembly mounting screws 18 are not critical and may vary. Likewise, the use of alternatives to screws (e.g., snap on connectors, etc.) can be used so long as the pressure bracket 14 is securely retained in place. The pressure bracket 14 can be formed in any suitable shape so long as when it is installed, it properly maintains the switches 6 along with their respective switch buttons 3–5 in pressure engagement with a wall of the switch housing 2. By configuring the switch housing 1 as described, sealed switch assemblies 1 can be fabricated such that individual components are easily replaced with a minimal amount of effort, and the repair process is performed at lower cost due to the ability to replace individual components rather than replacement of the entire sealed switch assembly 1 as was previously done. In addition, this method of component assembly is not limited to laparoscopic devices, but rather it can be used for any assembly which uses a number of components that have to be held in a particular location and/or position.

Figure 9:
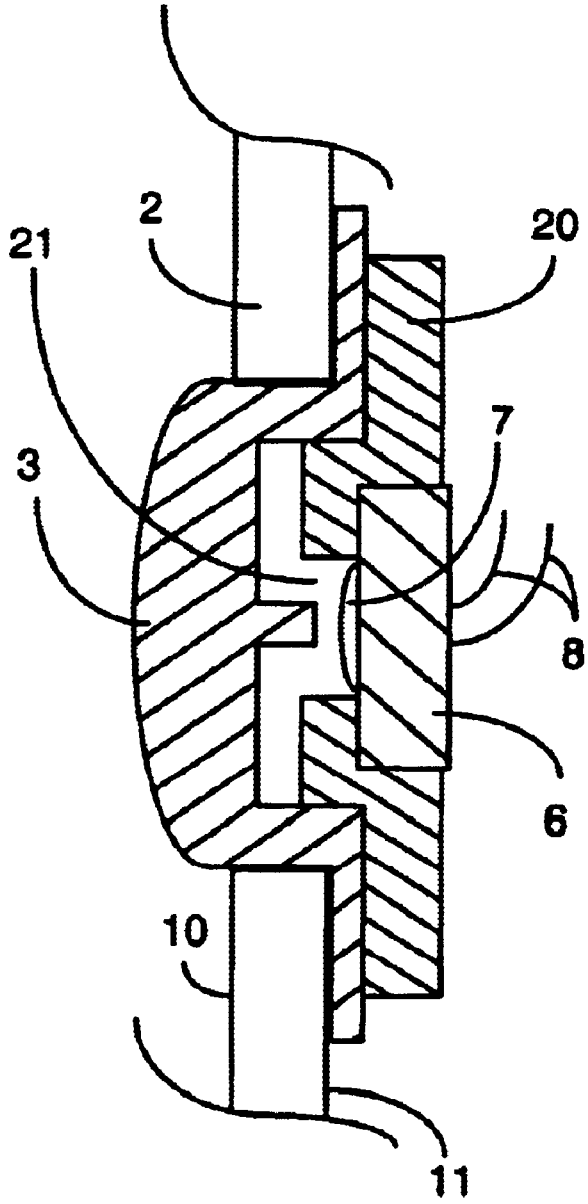
FIG. 9 is a side cutaway view of another alternative preferred embodiment of the switch housing assembly in which the switch is secured by a mounting bracket which is mounted inside of the switch button from the inside of the switch assembly.

In FIG. 9, another alternative preferred embodiment of the switch housing assembly is shown. This figure is a side cutaway view of the switch secured by a mounting bracket 20 which is mounted inside of the switch button 3 from the inside of the switch assembly 2. The mounting bracket 20 surrounds the edge of the switch 6 and secures it in place. In the preferred embodiment, the mounting bracket 20 has a central aperture to allow switch 6 to be inserted into it such that its lateral movement is restricted. The mounting bracket 20 is preferably rigid and sized such that when inserted into the switch button 3, it is held in frictional engagement by the switch button 3. Of course, those skilled in the art will recognize that it can also be secured to the switch button 3 by ridges which allow it to be snapped on, by adhesive, etc. An aperture 21 is also provided in the central portion of the flexible bracket 20 to allow the switch button 3 to activate the switch contact 7 of switch 6 when assembled.

In the preferred embodiment, the mounting bracket 20 is rigid to allow it to perform an additional function of compressing the perimeter of the switch button 3 against the interior wall 11 of the switch assembly 2 for the purpose of preventing fluid leaks. In addition, the mounting bracket 20 is sized to limit movement of the switch 6 such that it is automatically aligned with plunger 9 of the switch button 3.

While the invention has been described with respect to a preferred embodiment thereof, it will be understood by those skilled in the art that various changes in detail may be made therein without departing from the spirit, scope, and teaching of the invention. For example, the material used to fabricate the various components may be anything suitable for the particular application the device is used for, the size and shape of the switch buttons 3 and switches 6 can vary, the shape and size of the pressure bracket 14 can be made to suit any number of switches 6, etc. Accordingly, the invention herein disclosed is to be limited only as specified in the following claims.

I claim:

1. A switch housing assembly with sealed switches, further comprising:

at least one switch button;

a switch housing having at least one aperture suitably sized to accommodate the switch button;

at least one switch, the switch positioned in coordination with the switch button such that it is activated when the switch button is depressed; and a removable pressure bracket having means to securely attach to the switch housing, and further shaped such that when securely attached to the switch housing it maintains a predetermined number of switches in pressure contact with the switch housing by applying pressure against the switches such that they are pushed into pressure contact with a switch housing;

whereby the removable pressure bracket maintains a preselected number of switches in pressure contact with the switch housing when installed, and allows removal of the switches when it is removed.

2. A switch housing assembly, as in claim 1, further comprising:

an outer peripheral surface extending from the peripheral edge of the switch button, the outer peripheral surface further having a diameter wider than the aperture in the switch housing, such that when secured to the inner surface of the switch housing, the outer peripheral surface forms a fluid seal.

3. A switch housing assembly, as in claim 2, further comprising:

the switch is pressed directly against the switch button by the pressure bracket such that the outer peripheral surface of the switch button is maintains in pressure contact with the inner surface of the switch housing.

4. A switch housing assembly, as in claim 3, wherein:

the pressure bracket is secured to the switch housing by screws.

5. A switch housing assembly, as in claim 4, further comprising:

means to attach at least one switch housing assembly mounting screw to the switch housing assembly such that the switch housing assembly is securable to another device.

6. A switch housing assembly, as in claim 5, further comprising:

at least one of the bracket screws securing the pressure bracket to the switch housing, the bracket screw further having a threaded female portion; and the switch housing assembly mounting screw having a size sufficient to allow threading into the threaded female portion of the bracket screw;

whereby the switch housing assembly is secured to another device by the switch housing assembly mounting screw and the bracket screw.

7. A switch housing assembly, as in claim 1, wherein:

the switch housing has a plurality of apertures;

each aperture has an associated switch button and switch;

the pressure bracket is shaped and sized such that it secures the switches in pressure contact with the switch buttons;

whereby a single pressure bracket secures multiple switches to the switch housing.

8. A switch housing assembly, with sealed switches, further comprising:

at least one switch button;

a switch housing having at least one aperture suitably sized to accommodate the switch button;

at least one switch, the switch positioned in coordination with the switch button such that it is activated when the switch button is depressed; and a removable pressure bracket having means to securely attach to the switch housing, and further shaped such that when securely attached to the switch housing it maintains a predetermined number of switches in pressure contact with the switch housing;

an outer peripheral surface extending from the peripheral edge of the switch button, the outer peripheral surface further having a diameter wider than the aperture in the switch housing, such that when secured to the inner surface of the switch housing, the outer peripheral surface forms a fluid seal;

a rigid pressure ring positioned between the switch button and the switch and having a diameter such that when the switch is pressed against the rigid pressure ring, the rigid pressure ring applies pressure to the outer peripheral surface of the switch button;

whereby the removable pressure bracket maintains a preselected number of switches in pressure contact with the switch housing when installed, and allows removal of the switches when it is removed.

9. A switch housing assembly, as in claim 8, wherein:

a pressure bracket is secured to the switch housing by at least one bracket screw.

10. A switch housing assembly, as in claim 9, further comprising:

means to attach at least one switch housing assembly mounting screw to the switch housing assembly such that the switch housing assembly is securable to another device.

11. A switch housing assembly, as in claim 10, further comprising:

at least one of the bracket screws securing the pressure bracket to the switch housing, the bracket screw further having a threaded female portion; and the switch housing assembly mounting screw having a size sufficient to allow threading into the threaded female portion of the bracket screw;

whereby the switch housing assembly is secured to another device by the switch housing assembly mounting screw and the bracket screw.

12. A switch housing assembly, with sealed switches, further comprising:

at least one switch button;

a switch housing having at least one aperture suitably sized to accommodate the switch button;

at least one switch, the switch positioned in coordination with the switch button such that it is activated when the switch button is depressed; and a removable pressure bracket having means to securely attach to the switch housing, and further shaped such that when securely attached to the switch housing it maintains a predetermined number of switches in pressure contact with the switch housing;

an outer peripheral surface extending from the peripheral edge of the switch button, the outer peripheral surface further having a diameter wider than the aperture in the switch housing, such that when secured to the inner surface of the switch housing, the outer peripheral surface forms a fluid seal; and a mounting bracket, the mounting bracket removably attached to the switch such that movement of the switch is limited, and further, the mounting bracket removably attached to the switch button such that the switch is aligned with the switch button such that the switch is activated when the switch button is depressed, and the mounting bracket providing pressure against the peripheral edge of the switch button to form a fluid seal between the peripheral edge of the switch button and the switch housing when secured by the pressure bracket;

whereby the mounting bracket aligns the switch with a switch cover and provides pressure to the peripheral edge of the switch button to form a fluid seal, and the removable pressure bracket maintains a preselected number of switches in pressure contact with the switch housing when installed, and allows removal of the switches when it is removed.

13. A switch housing assembly, as in claim 12, further comprising:

means to attach at least one switch housing assembly mounting screw to the switch housing assembly such that the switch housing assembly is securable to another device.

14. A switch housing assembly, as in claim 13, further comprising:

at least one of the bracket screws securing the pressure bracket to the switch housing, the bracket screw further having a threaded female portion; and the switch housing assembly mounting screw having a size sufficient to allow threading into the threaded female portion of the bracket screw;

whereby the switch housing assembly is secured to another device by the switch housing assembly mounting screw and the bracket screw.

15. A switch housing assembly with sealed switches, further comprising:

a switch housing having at least one aperture;

at least one switch button, the switch button secured to the outer surface of the switch housing such that its outer peripheral edge forms a seal around the aperture;

at least one switch, the switch positioned in coordination with the switch button such that it is activated when the switch button is depressed;

a removable pressure bracket having means to securely attach to the switch housing, and further shaped such that when securely attached to the switch housing it maintains a predetermined number of switches in pressure contact with the switch housing; and a mounting bracket, the mounting bracket removably attached to the switch such that movement of the switch is limited, and further, the mounting bracket removably attached to the switch button such that the switch is aligned with the switch button such that the switch is activated when the switch button is depressed, and the mounting bracket providing pressure against the peripheral edge of the switch button to form a fluid seal between the peripheral edge of the switch button and the switch housing when secured by the pressure bracket;

whereby the removable pressure bracket secures a preselected number of switches in pressure contact with the switch housing when installed, allows removal of the switches when it is removed, and the mounting bracket aligns the switch with a switch cover and provides pressure to the peripheral edge of the switch button to form a fluid seal.

16. A method of simultaneously securing multiple switches to a switch housing with a pressure bracket, including the steps of:

positioning at least one switch and switch button in coordination with an aperture in a switch housing such that the switch is positioned inside of the switch housing and is activated when the switch button is depressed on the outside of the switch housing;

securely attaching a removable pressure bracket to the switch housing such that when securely attached to the switch housing it maintains a predetermined number of switches in pressure contact with the switch housing; and positioning a pressure ring between the switch button and a switch such that when the pressure bracket secures the switch, pressure is applied to the peripheral edge of the switch button such that a fluid seal is formed whereby the removable pressure bracket maintains a preselected number of switches in pressure contact with the switch housing when installed, and allows removal of the switches when it is removed.

17. A method, as in claim 16, including the additional steps of:

extending a peripheral edge on the switch button such that it contacts the inner surface of the switch housing when the switch button is installed and the switch housing; and pressing the peripheral edge of the switch button against the inside of the switch housing such that a fluid seal is formed.

18. A method, of simultaneously securing multiple switches to a switch housing with a pressure bracket, including the steps of:

positioning at least one switch and switch button in coordination with an aperture in a switch housing such that the switch is positioned inside of the switch housing and is activated when the switch button is depressed on the outside of the switch housing;

securely attaching a removable pressure bracket to the switch housing such that when securely attached to the switch housing it maintains a predetermined number of switches in pressure contact with the switch housing;

attaching a mounting bracket to the switch such that movement of the switch is limited;

securing the mounting bracket to the switch button such that the switch is automatically aligned with the switch button;

extending the peripheral edge of the mounting bracket such that it overlaps at least a portion of the peripheral edge of the switch button when the mounting bracket is secured to the switch button; and providing pressure against the peripheral edge of the switch button to form a fluid seal between the peripheral edge of the switch button and the switch housing when secured by the pressure bracket;

whereby the mounting bracket simultaneously aligns the switch with a switch cover and provides pressure to the peripheral edge of the switch button to form a fluid seal, and the removable pressure bracket maintains a preselected number of switches in pressure contact with the switch housing when installed, and allows removal of the switches when it is removed.

* * * * *